United States Patent [19]

Hogenson

[11] 4,394,010

[45] Jul. 19, 1983

[54] SHEET FEEDER

[75] Inventor: Raymond A. Hogenson, Shoreview, Minn.

[73] Assignee: Minnesota Mining and Manufacturing Company, St. Paul, Minn.

[21] Appl. No.: 286,338

[22] Filed: Jul. 23, 1981

[51] Int. Cl.[3] ..... B65H 3/30

[52] U.S. Cl. ..... 271/22; 271/114; 271/127

[58] Field of Search ..... 271/21, 22, 37, 113, 271/114, 115, 127

[56] References Cited

U.S. PATENT DOCUMENTS 2,165,232 7/1939 Curtis ..... 271/22

3,866,901 2/1975 Brock ..... 271/21

*Primary Examiner*—Richard A. Schacher

*Attorney, Agent, or Firm*—Cruzan Alexander; Donald M. Sell; David W. Anderson

[57] ABSTRACT

A sheet feeder for feeding sheets from a stack thereof, which feeder automatically fans or separates the uppermost sheets within the stack to facilitate their feeding. The feeder includes a feed roll brake releasably coupled to a feed roll which brake rotates with the feed roll until a pre-determined force is applied on the brake by a spring that has been compressed by the normal feeding rotation of the feed roll, causing the feed roll to rotate in the opposite direction to the normal feed direction, thereby fanning the uppermost sheets.

5 Claims, 2 Drawing Figures

SHEET FEEDER

The present invention relates to a sheet feeder for feeding individual sheets from a stack thereof.

BACKGROUND OF THE INVENTION

In order to feed single sheets, for example of paper, from a stack of sheets, it is necessary to separate the sheets from one another. Typically this is done by extending a portion of the frame of the sheet feeder at positions corresponding to two of the corners on the leading edge of the uppermost sheet within the stack of sheets, so that the frame slightly overlaps these two corners. This structure, often referred to as corner nips, cause the uppermost sheet to buckle when it is driven forward by the feed means of the sheet feeder. Ideally this buckling separates the uppermost sheet from the sheets adjacent to it. Corner nips, however, are not 100% effective, and due to such phenomena as static electricity, adjacent sheets often cling together in spite of the action of the corner nips. Manufacturers therefore often instruct the users of sheet feeders to manually fan or shuffle one edge of the stack of sheets prior to inserting the sheets into the sheet feeder. This fanning helps to separate the various sheets from one another, and thus assist the corner nips in their function of separating the sheets.

SUMMARY OF THE INVENTION

The present invention is a sheet feeder which as part of the feeding operation, automatically fans or separates the uppermost sheets so that they can be more easily fed.

This invention comprises a frame upon which a stack of sheets can be supported, and a feed roll for feeding the sheets which is rotatably supported on the frame. Means are provided for affording contact between the feed roll and the uppermost sheet within the stack of sheets. One end of the axle of the feed roll is connected to drive means which are intermittently rotated when a sheet is to be fed. The present invention also includes a feed roll brake releasably coupled to the axle of the feed roll, in a manner affording its rotation with the axle, until a predetermined force is applied on the feed roll brake, in a direction opposing its rotation by the drive means, at which time the feed roll brake will slip with respect to the axle. Biasing means are included between the frame of the sheet feeder and one end of the feed roll brake, such that the biasing means will be compressed as the feed roll brake is rotated. The biasing means therefore, can exert a counter force on the feed roll brake which is in turn transmitted to the axle and feed roll. As the feed roll brake rotates in response to the rotation of the axle by the drive means, the counter force exerted due to the compression of the biasing means increases, and eventually reaches a pre-determined magnitude sufficient to cause the slippage of the feed roll brake with respect to the axle. The feed roll however continues to rotate due to the drive means, for sufficient revolutions to feed a sheet from the stack of sheets. When this sheet has been fed, the drive means are de-energized, the counter force exerted by the feed roll brake and the biasing means, acts against the momentum of the de-energized drive means and the feed roll, bringing the feed roll to a stop. The biasing means are chosen however to exert a sufficient force on the feed roll brake to not only stop the feed roll, but additionally, to cause the rotation of the feed roll brake in a direction opposite to that in which it had been driven by the drive means. This counter rotation of the feed roll is transmitted to the stack of sheets, through the frictional contact of the feed roll with the sheets, causing the uppermost sheets to be pulled back from the corner nips. This action is similar to the manual fanning action which is utilized to separate the adjacent sheets. Hence, this counter rotation of the feed roll assists in the separation of the sheets and affords a more consistent feeder operation.

DESCRIPTION OF THE DRAWING

The present invention will be further described hereinafter with reference to the accompanying drawing wherein.

DETAILED DESCRIPTION OF THE PREFERRED EMBODIMENT

Figure 1:
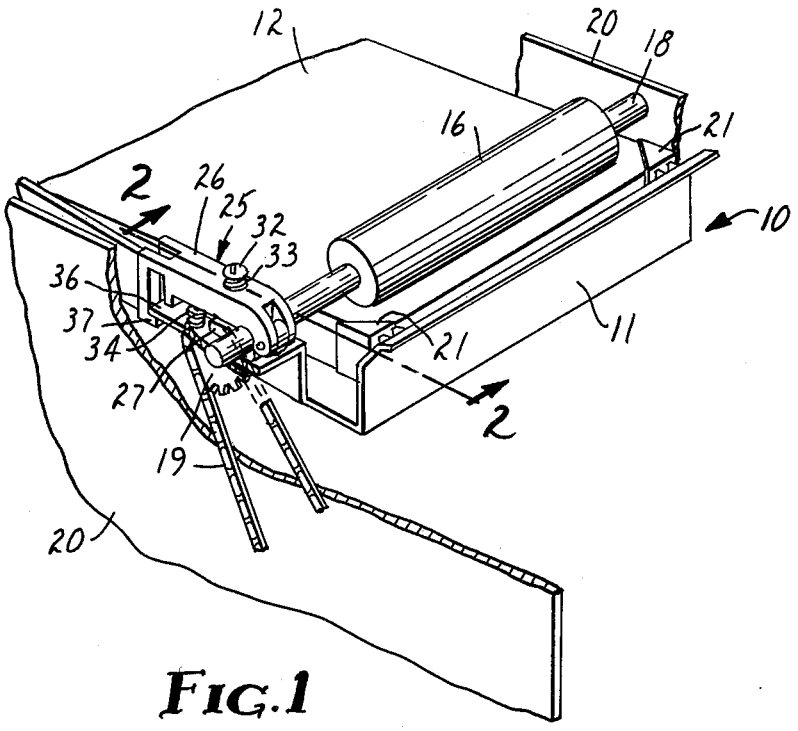
FIG. 1 is a perspective view of a sheet feeder according to the present invention.
Figure 2:
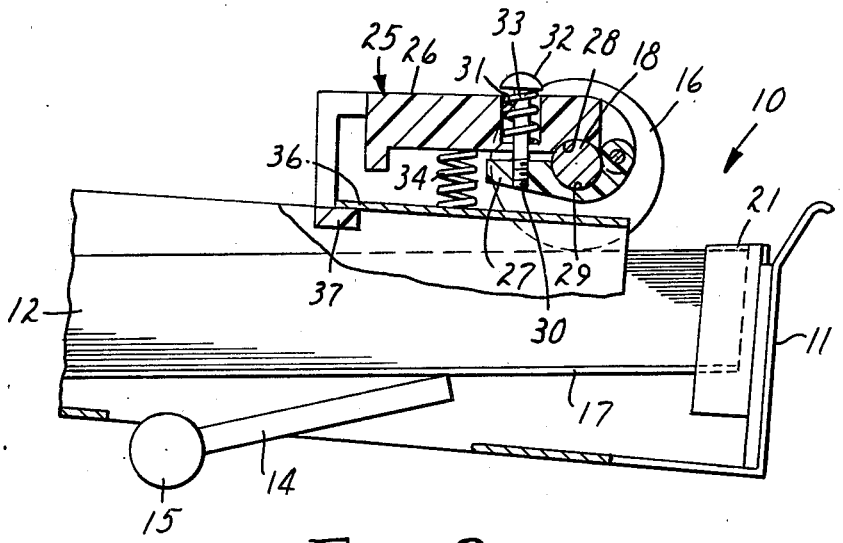
FIG. 2 is a longitudinal sectional view taken along line 2—2 of FIG. 1, with portions broken away to show internal structure.

The sheet feeder 10 according to the present invention is illustrated in FIG. 1, and comprises a tray 11 for supporting a stack of sheets 12, as for example of paper. A lift arm 14 protrudes through the bottom of the tray 11 and pivots on a supporting axle 15 to lift the stack of sheets 12 toward a feed roll 16. To provide support for the stack of sheets 12 during this lifting process a rigid member 17 is typically placed between the lift arm 14 and the stack of sheets 12. The feed roll 16 is mounted upon an axle 18 which is rotatably supported by side portions 20 of the tray 11, and which can be rotated by conventional drive means 19. Also supported on the tray 11 are a pair of floating corner nips 21 which are disposed adjacent the leading edge of the stack of sheets 12, such that the corner nips 21 will be contacted by the corners of the leading edge of the stack of sheets 12 as the stack is lifted toward the feed roll. The corner nips 21 are supported on the tray 11 through a tongue and groove arrangement, with the tongue being on a generally vertical extending portion of the corner nips 21 and the groove being on the front edge of the tray 11. With this mounting arrangement, the corner nips 21 can be lifted upward by the stack of sheets 12 as the stack is being lifted by the lift arm 14.

The sheet feeder 10 of the present invention also includes a feed roll brake 25 mounted on the axle 18. The feed roll brake 25 serves three functions. It not only acts against the momentum of the feed roll 16 to stop the feed roll 16, in combination with the feed roll 16 it also fans or works the uppermost sheets 12 within the stack, to separate to these sheets 12 and thus afford a more consistent feeder operation. Additionally, the feed roll brake 25 tends to reduce the forward force exerted by the stack of sheets 12 on the corner nips 21, allowing the corner nips 21 to be formed with a more lightweight construction which facilitates their floating action with respect to the tray 11. These three functions of the feed roll brake 25 will be more clearly understood through a description of the structures forming the feed roll brake 25. The feed roll brake 25 comprises a first lever arm 26 and a second lever arm 27 which are hingedly mounted together on one end. Each of these lever arms 26 and 27 contain an indentation 28 and 29 respectively, which indentations are introrsely positioned adjacent the hinged end of the lever arms, and which indentations are adapted to receive a portion of the outer circumference of the axle 18 of the feed roll 16, when the distal ends of the lever arms 26 and 27 are brought together. Means are provided to bias the distal end of the second lever arm 27 toward the first lever arm 26 in order to bring the surfaces forming the indentations 28 and 29 into frictional contact with the axle 18. These means include a threaded bore 30 adjacent the distal end of the second lever arm 27 and a larger bore 31 in the first lever arm located to correspond with the threaded bore 30 when the two lever arms are brought together. A bolt 32 engages the threaded bore 30 and passes loosely through the larger bore 31. A spring 33 between the head of the bolt 32 and the first lever arm 26 biases the two lever arms 26 and 27 together, and the compression of this spring 33 is adjustable by adjusting the bolt 32. Hence, means are provided for coupling the feed roll brake 25 to the axle 18 through the frictional forces exerted on the axle 18 by the feed roll brake 25. When these frictional forces are sufficient, the feed roll brake 25 will rotate with the axle 18. If a sufficient force is however exerted on the first lever arm 26 in opposition to the frictional forces on the axle 18, the feed roll brake 25 can be made to slip with respect to the axle 18. Hence, the feed roll brake 25 is releasably coupled to the axle 18. As can be seen, the frictional force on the axle 18 is dependent upon the adjustment of the bolt 32 and the resulting amount of compression of the spring 33. Thus the bolt 32 can be adjusted to control the magnitude of the counter force required to cause this slippage of the feed roll brake 25 with respect to the axle 18. The feed roll brake 25 also includes a second spring 34 which is biased between an upper portion 36 of the tray 11 and of the first lever arm 26. The distal end of the first lever arm 26 includes a projecting ledge 37 which can engage the upper portion 36 of the tray 11 in order to maintain the second spring 34 in compression. It is this second spring 34 which provides the counter force causing the slippage of the feed roll brake 25.

The sheet feeder of the present invention operates in the following manner. As the lift arm 14 lifts the stack of sheets 12, the sheets 12 contact the corner nips 21 which are also lifted. Eventually, the stack of sheets 12 contact the feed roll 16, and as the feed roll 16 is rotated in a counter-clockwise direction by the drive means 19, the uppermost sheet of the stack of sheets 12 is urged forward. At the same time the feed roll 16 is rotating, the feed roll brake 25 mounted on the axle 18 is also rotated. This rotation further compresses the second spring 34 mounted between the feed roll brake 25 and the upper portion 36 of the tray 11. As this spring 34 is compressed, the counter force which it exerts upon the feed roll brake 25 increases until it is sufficient to overcome the frictional forces between the lever arms 26 and 27 and the axle 18, and the feed roll brake 25 begins to slip with respect to the axle 18. The feed roll 16 however continues to be rotated by the drive means 19 until the uppermost sheet within the stack of sheets 12 is fed. At this time, the drive means 19 are de-energized, thus eliminating the counter-clockwise rotational force on the feed roll 16. The force of the compressed spring 34 remains acting against the distal end of the first lever arm 26, opposing any continued rotation of the feed roll 16 due to the momentum of the feed roll 16 and the drive means 19. This force is sufficient to not only bring the feed roll 16 to a rapid stop, it also causes a counter rotation of the feed roll brake 25, i.e. in the opposite direction to that in which it had been driven by the drive means 19. This counter rotation of the first lever arm 26 rotates the feed roll 16 in a clockwise direction until the force exerted on the first lever arm 26 by the spring 34 is checked by the engagement of the projecting ledge 37 against the upper portion 36 of the tray 11. The clockwise rotation of the feed roll 16 occurs while the stack of sheets 12 are in contact with the feed roll 16. Hence, the clockwise rotation of the feed roll 16 forces the uppermost sheets within the stack of sheets 12 away from the corner nips. This reverse motion of the uppermost sheets 12, fans the uppermost sheets 12 and thus facilitates their separation.

It has been found that the spring 34 also absorbs some of the shock traditionally applied against the corner nips 21 as the uppermost sheets 12 are urged forward by the feed roll 16. Hence, the corner nips 21 need not be as ruggedly constructed as is typical with existing sheet feeders. The lighter-weight construction for the corner nips 21 afforded by the present invention facilitates their floating action on the tray 11.

Having thus described the preferred embodiment of the present invention, it will be understood that changes may be made in size, shape or configuration of some of the parts described herein without departing from the present invention as recited in the appended claims.

What is claimed is:

1. A sheet feeder comprising frame means for supporting a stack of sheets, a feed roll for feeding said sheets having an axle which is rotatably supported on said frame means, means for affording contact of the uppermost sheet within the stack of sheets with said feed roll, drive means for intermittently rotating said axle, a feed roll brake mounted on said axle, including means for releasably coupling said feed roll brake to said axle affording the rotation of said feed roll brake with said axle, until the application of a predetermined force on said feed roll brake in a direction opposing the rotation of said axle by said drive means, and biasing means for applying said predetermined force, and for rotating said feed roll brake, said axle, and said feed roll in a direction opposite to the direction of rotation caused by said drive means upon the cessation of the rotation of said axle by said drive means, thereby urging the uppermost sheets in the stack of sheets in a direction opposite to the feeding direction, and accordingly fanning the uppermost sheets of said stack of sheets.

2. A sheet feeder as claimed in claim 1 wherein said feed roll brake includes an elongate first lever arm having a surface adjacent its proximate end which is adapted to receive a portion of the outer circumference of said axle, and a second lever arm having a proximate end pivotally mounted to the proximate end of said first lever arm, said second lever arm also having a surface adjacent its proximate end which is adapted to receive a portion of the outer circumference of said axle, and wherein said means for coupling said feed roll brake to said axle includes means for adjustably biasing the distal ends of said first and second lever arms together to bring said surfaces into frictional contact with said axle, whereby said feed roll brake will rotate with said feed roll as long as the frictional forces between said surfaces and said axle are greater than said predetermined force applied by said biasing means against said feed roll brake, and whereby said feed roll brake will slip with respect to said axle when said frictional forces between said surfaces and said axle are less than or equal to said predetermined force.

3. A sheet feeder as claimed in claim 2 wherein said means for biasing the distal ends of said first and second lever arms together comprises a bolt, a threaded bore within the distal end of said second lever arm which is adapted to engage said bolt, a larger bore adjacent the distal end of said first lever arm which is adapted to loosely receive said bolt, and a spring positioned between the head of said bolt and the upper portion of said first lever arm.

4. A sheet feeder as claimed in claim 2 wherein said biasing means for applying said predetermined force on said feed roll brake comprises a spring positioned between said first lever arm and said frame means.

5. In a sheet feeder for feeding sheets from a stack of sheets, having a driven feed roll which includes a rotatable axle that is mounted on the sheet feeder and drive means which upon being energized rotate the feed roll, the improvement comprising a feed roll brake for use with said sheet feeder which includes a first and a second lever arm hingedly attached on one end, each of said lever arms having an introrsely positioned indentation adjacent said hingedly attached end, which indentation is adapted to receive a portion of the circumference of said axle, means for biasing said second lever arm toward said first lever arm thereby bringing said indentations into frictional contact with said axle to afford the rotation of said lever arms with said axle, and means for biasing said first lever arm in a direction affording the rotation of said first lever arm in the opposite direction to the direction of rotation due to said drive means, the force of which increases with the rotation of said first lever arm, whereby said lever arms will rotate with said axle until the biasing force on said first lever arm equals the frictional forces exerted between said indentations and said axle, at which time said lever arms will slip with respect to said axle; and whereby said feed roll brake and said axle will be rotated in the opposite direction to the direction of rotation due to said drive means, when said drive means are de-energized, thereby fanning the uppermost sheets in said stack of sheets facilitating their separation from each other.

* * * * *